US005515023A

United States Patent [19]

Marach et al.

[11] Patent Number: 5,515,023

[45] Date of Patent: May 7, 1996

[54] OVERCURRENT PROTECTION MODULE

[75] Inventors: David R. Marach, Marengo, Ill.; Angelina M. Bernardi, St. Louis, Mo.; Ruel E. Davis, Fairview, N.C.; Steven R. Goble, Ballwin, Mo.

[73] Assignee: Cooper Industries, Houston, Tex.

[21] Appl. No.: 309,492

[22] Filed: Sep. 23, 1994

Related U.S. Application Data

[63] Continuation-in-part of Ser. No. 91,952, Jul. 15, 1993, abandoned.

[51] Int. Cl.[6] ..... H01H 85/50; H01H 85/02; H01H 85/22; H01H 85/30

[52] U.S. Cl. ..... 337/213; 337/194; 337/209; 337/206; 361/833; 361/835; 439/622

[58] Field of Search ..... 337/208, 209, 337/210, 211, 212, 213, 214, 215, 216, 201, 206, 194; 439/620, 621, 622; 361/833, 834, 835

[56] References Cited

U.S. PATENT DOCUMENTS

| | | | |
|---|---|---|---|
| 2,905,791 | 9/1959 | Edmunds . | |
| 3,732,516 | 5/1973 | Puetz | 337/194 |
| 4,013,989 | 3/1977 | Born | 337/227 |
| 4,077,024 | 2/1978 | Lisnay | 335/8 |
| 4,488,767 | 12/1984 | Lehman | 337/213 |
| 4,559,504 | 12/1985 | Krec | 337/194 |
| 4,966,561 | 10/1990 | Norden | 337/211 |

*Primary Examiner*—Leo P. Picard
*Assistant Examiner*—Stephen T. Ryan
*Attorney, Agent, or Firm*—Burns, Doane, Swecker & Mathis

[57] ABSTRACT

An overcurrent protection module includes a base unit and a removable fuse holder. The base unit is mountable on a panel or a DIN rail so that a containing space for the fuse holder stands perpendicular to a plane of the panel or the DIN rail, and in line with a conventional wiring orientation. The fuse holder includes at least three fuse slots arranged in a single plane, so that in a position inserted in the base unit, the fuse slots are perpendicular to the plane of the panel or DIN rail. Line terminals are singularly located on a first side wall of the base unit and load terminals are singularly located on a second side wall, opposite to the first side wall. The overcurrent protection module according to the invention is simpler to mount and requires less surface mounting space than a conventional fuse block. The overcurrent protection module also provides protection from shock hazard by shielding an operator from contact with live terminals or fuses.

14 Claims, 5 Drawing Sheets

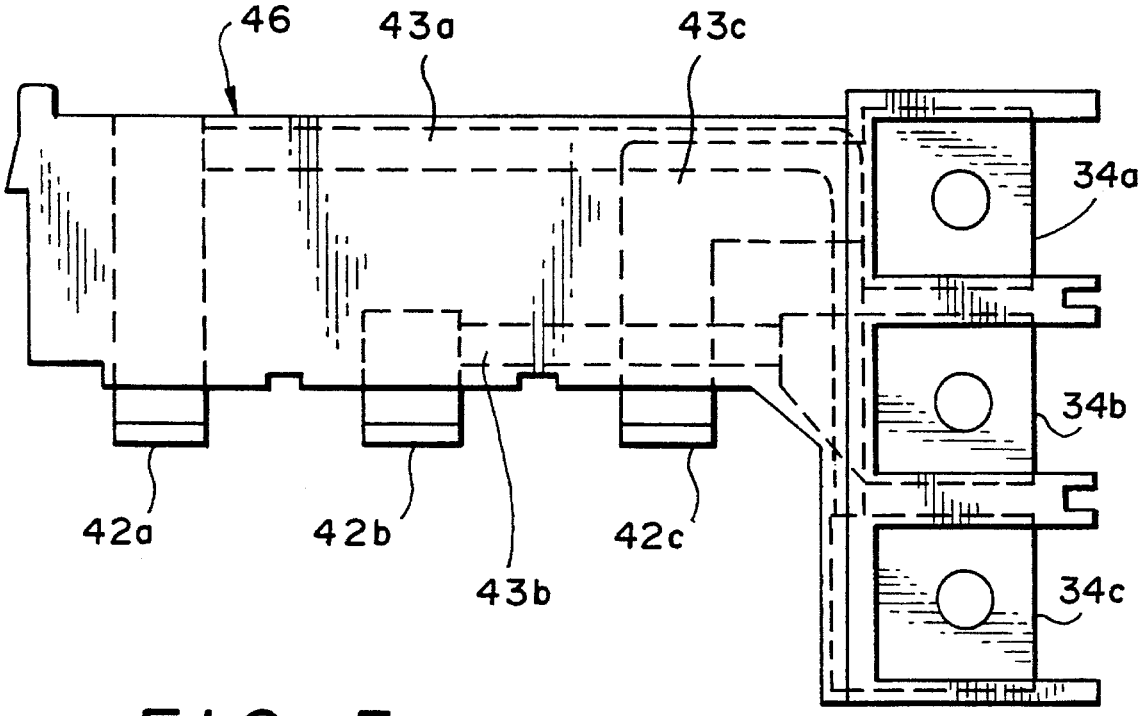
FIG. 5
FIG. 6
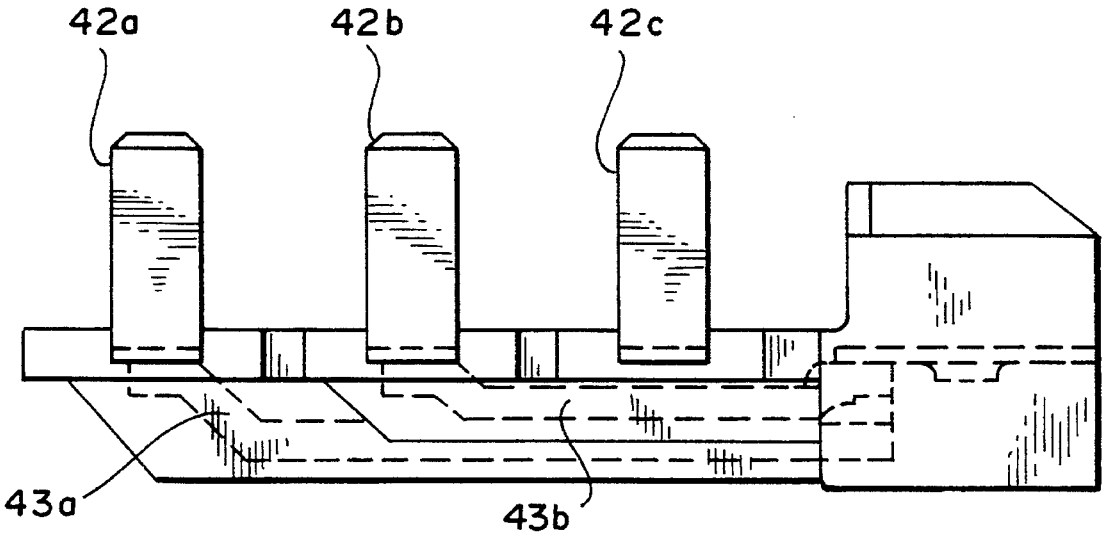

OVERCURRENT PROTECTION MODULE

This application is a continuation-in-part of applicants' U.S. application Ser. No. 08/091,952, filed Jul. 15, 1993, now abandoned.

FIELD OF THE INVENTION

The present invention relates to fuses and to an overcurrent protection module including fuses.

BACKGROUND AND SUMMARY OF THE INVENTION

In control panels for electrical equipment, space is an important consideration for the positioning and spacing of the various devices and the routing of wires through the control panel.

Conventional fuse holders for multiple fuse arrangements typically mount the fuses adjacent to one another and parallel to the back panel of the control panel, which takes up considerable space. In addition, the fuses and the connecting terminals are exposed, which can present a danger to an operator working in the panel.

The present invention, generally, provides a fuse holder for three or more fuses that solves the problems of space and safety in the art.

More particularly, the present invention provides an overcurrent protection module having a fuse holder for three or more fuses, for example, for a three-phase circuit, that takes up less room in a control panel than does a conventional fuse holder. The overcurrent protection module of the present invention is narrower than conventional fuse holders carrying the same number of fuses.

The overcurrent protection module according to the present invention provides a unit that contains three or more fuses in an enclosed unit to protect an operator from contact with exposed electrical terminals or other live elements. The overcurrent protection module according to the present invention also provides a fuse holder in a base unit that is removable from the base unit to allow replacement of fuses in the fuse holder without exposing an operator to danger of electrical contact.

According to another aspect of the present invention, the overcurrent protection module includes a base unit that mounts on a panel or a DIN rail so that a containing space in the base unit is positioned perpendicular to the plane of the panel or DIN rail, and in line with conventional wiring orientation. The overcurrent protection module also includes a fuse holder that inserts in the base unit. The fuse holder is formed to hold three or more fuses in a single plane that, in an inserted position of the fuse holder, is also perpendicular to the plane of the panel or DIN rail.

According to a further aspect of the invention, the fuse holder includes individual slots for securing a fuse and means connecting each fuse in an electric circuit in the base unit. The electrical connection means includes plug-type connectors at the opposite end portions of the fuse slots. The plug-type connectors are positioned to connect with mating connectors in the base unit when the fuse holder is inserted in the base unit. According to the invention, the plug-type connectors are arranged parallel to the plane of the fuse slots.

According to another aspect of the invention, load and line terminals are provided on opposite side walls of the base unit. All of the line terminals are located on a first side wall of the base unit and all of the load terminals are located on a second side wall, opposite to the first side wall. This arrangement simplifies electrically connecting the overcurrent protection module in the control panel and simplifies the routing of the connecting wires, which contributes both to safety and saving space on the control panel.

According to yet another aspect of the invention, the electrical connection means to connect the fuses to the line and load terminals include electrical conductors connecting the plug-type connectors to the load and line terminals. The conductors for the load terminals are arranged in a single plane that is perpendicular to the plane of the plug-type connectors and parallel to the bottom portion of the base unit. Similarly, the conductors for the line terminals are also arranged in a single plane perpendicular to the plane of the plug-type connectors. The arrangement of the load and line conductors advantageously allows the at least three fuses to be arranged in a narrow space with the load and line terminals at opposite sides of the base unit.

According to another aspect of the invention, the base unit electrical connection means comprises a first terminal block mounted in the base unit adjacent to the load terminals and a second terminal block mounted adjacent to the line terminals, both terminal blocks oriented parallel to the bottom of the base unit. Three individual connectors are supported by the first terminal block and positioned in a plane extending upwardly from the terminal block and perpendicular to the second side wall of the base unit. Each of the connectors is attached to an electrical conductor supported in the first terminal block. Each conductor is also connected to one of the load terminals. Three individual connectors are supported by the second terminal block and positioned in a row perpendicular to the first wall. Each of the connectors is attached to an electrical conductor disposed in the second terminal block, and each conductor is connected to one of the line terminals.

According to a preferred embodiment of the invention, a portion of the second terminal block extends through the first side wall and supports the line terminals and a portion of the first terminal block extends through the second side wall and supports the load terminals.

According to a preferred embodiment of the invention the base unit electrical connectors and the fuse holder electrical connection means include mating plug-type connectors for ease of connecting and disconnecting the fuse holder by movement of the fuse holder respectively into and out of the base unit.

BRIEF DESCRIPTION OF THE DRAWING FIGURES

The present invention can be further understood with reference to the following description in conjunction with the appended drawings, wherein like elements are provided with the same reference numerals. In the drawings:

FIG. 5 is a top view of a first terminal block removed from the overcurrent protection module to illustrate details of construction;

FIG. 6 is a side view of the first terminal block of FIG. 5;

DETAILED DESCRIPTION OF PREFERRED EMBODIMENTS

Figure 1:
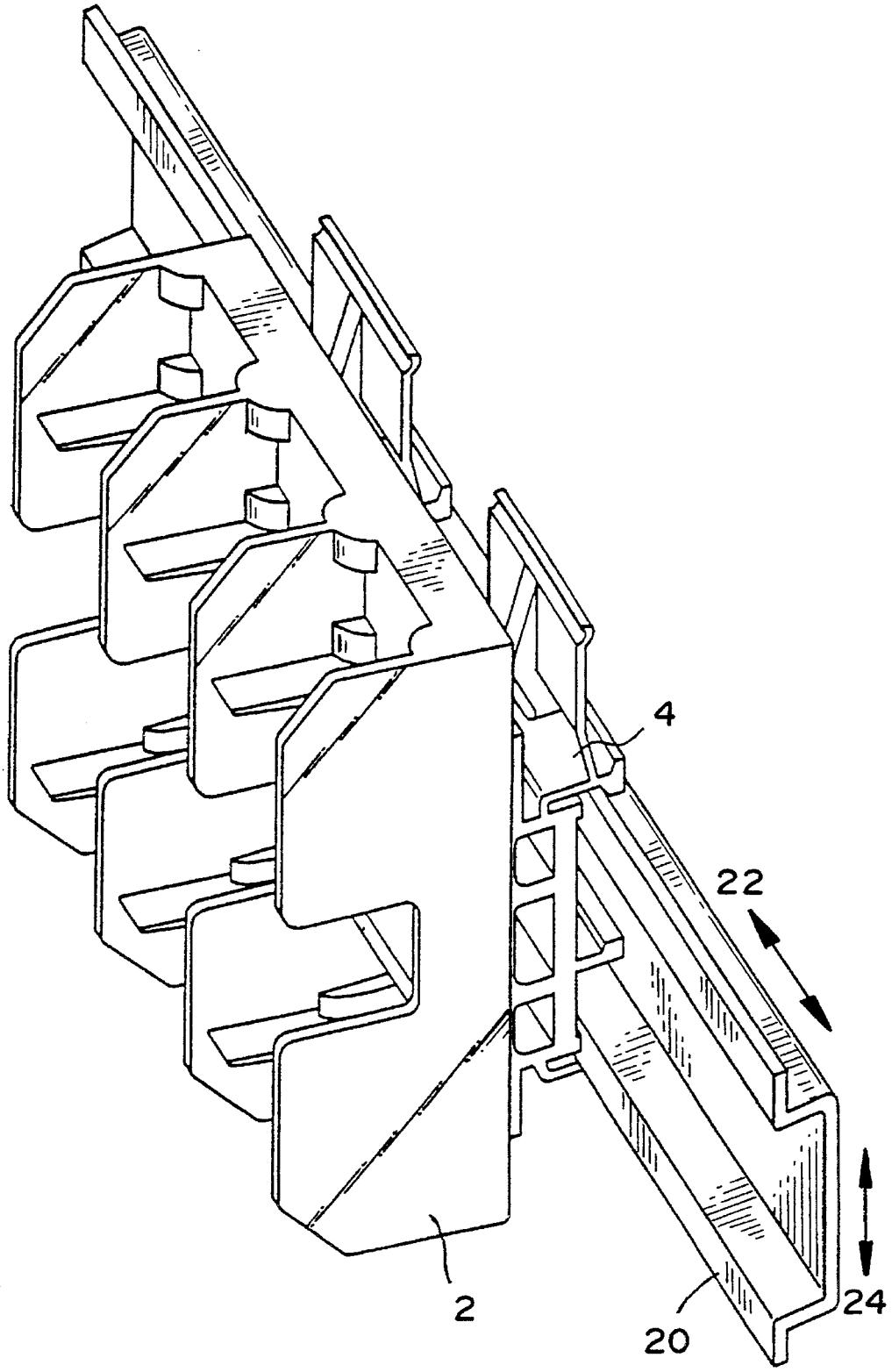
FIG. 1 (PRIOR ART)
FIG. 1 is a perspective view of a conventional fuse holder known in the art.

FIG. 1 is a perspective view of a conventional fuse block 2 as is known in the art. The fuse block 2 is illustrated mounted to a DIN rail 20 by a DIN rail adapter 4. Typically, the DIN rail 20 is mounted on an inside wall in a control panel (not illustrated). The fuse block 2 includes three slots 5 for mounting fuses. As may be seen, the fuse slots 5 are arranged side by side along the lengthwise or longitudinal direction 22 of the DIN rail 20. The longitudinal axes of the fuses are perpendicular to the longitudinal direction 22 of the DIN rail 20, and parallel to a widthwise or transverse direction 24 of the DIN rail. This arrangement, which is typical in the art, takes up much space along the DIN rail 20, and consequently, much space in the control panel in which the DIN rail is mounted.

Figure 2:
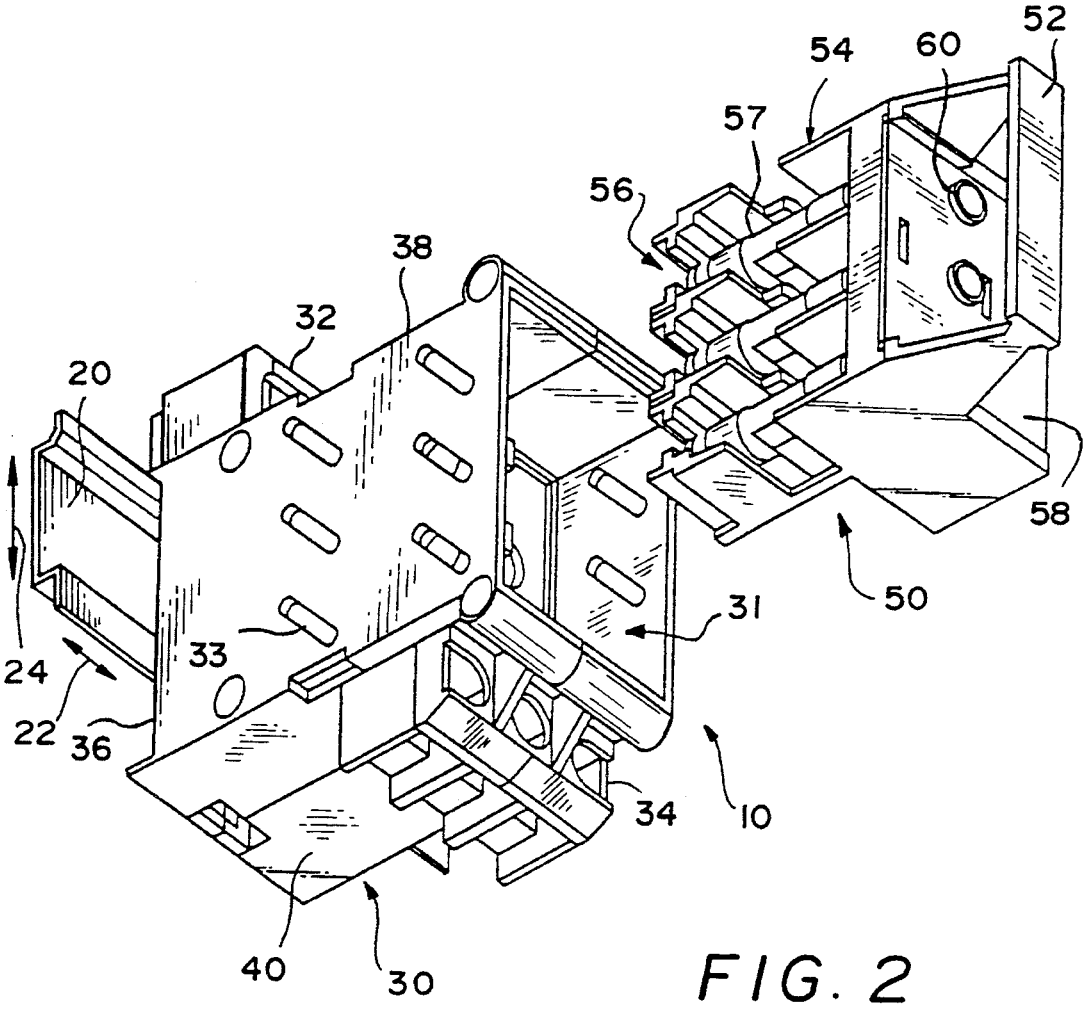
FIG. 2 is a perspective view of a overcurrent protection module of the present invention showing a fuse holder in a removed position outside a base unit.

An overcurrent protection module 10 according to the present invention is illustrated in FIG. 2. The overcurrent protection module 10 is comprised of two main elements, a base, or housing, unit 30 and a removable fuse holder 50. The fuse holder 50 is illustrated in a removed position, and is also insertable in the base unit 30 to an inserted position. Each of the fuse holder 50 and base unit 30 include electrical connection means to establish an electrical circuit including the fuses through the overcurrent protection module 10, as further described below.

The base unit 30 is a generally rectangular shaped housing having four side walls and a bottom 36 that define an interior receiving space 31 for the fuse holder 20. The base unit 30 in FIG. 2 is shown mounted to a DIN rail 20. The base unit 30 is also panel mountable and the advantages of the invention described herein apply equally to such a configuration.

Figure 3:
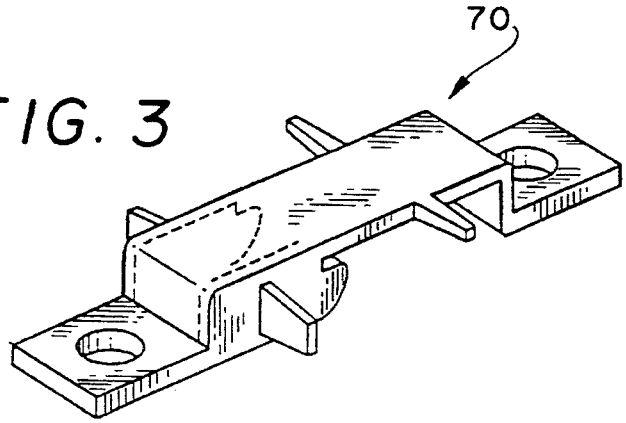
FIG. 3 is a perspective view of an adaptor for mounting the overcurrent protection module of FIG. 2 to a DIN rail.

The base unit 30 may be mounted to the DIN rail 20 in any convenient manner. For example, an adapter 70, illustrated in FIG. 3, may be fastened to the bottom 36 of the base unit 30 to mount the base unit to the DIN rail 20.

The base unit 30 includes externally located terminals 32, 34 for connecting the base unit in an electrical circuit. According to the invention, the terminals 32, 34 are arranged so that the load terminals are singularly located on one side of the base unit 30 and the line terminals are singularly located on the opposite side of the base unit. In the embodiment illustrated in the figures, which is not meant to be restrictive, the terminals 32 on a first side wall 38 of the base unit 30 are line terminals, and the terminals 34 on a second side wall 40 are all load terminals. The arrangement of the terminals 32, 34 on the base unit 30 simplifies the wiring and routing of wires in a control panel to the overcurrent protection module 10 of the present invention. All of the line wires may be routed to a single side 32 of the module 30 and all of the load wires to an opposite side 34. This arrangement is particularly advantageous in modules having three or more fuses, for example, in modules for three-phase circuits. In situations where two or more modules 30 are placed side-by-side, the wires to the terminals will not interfere with the tight positioning of the modules.

The base unit 30 also includes a plurality of slotted openings 33 on the third and fourth side walls. The slotted openings 33 allow air to pass in and out of the space 31 containing the fuse holder 50 to provide cooling.

The fuse holder 50 includes a handle 52 and main body portion 54. The main body portion 54 inserts in the base unit 30, and includes three fuse holding slots 56. A planar top 58 that closes off the containing space in the base unit 30 when the fuse holder 50 is in the inserted position. Indicator lamps 60 are mounted on the top 58 of the fuse holder 50. The indicator lamps 60 are each integrated with a fuse holding slot 56 and are connected in a circuit to light when the fuse needs to be replaced, that is, when the fuse has blown.

The fuse holding slots 56 are positioned in a single plane that is perpendicular to the plane of the top 58. When the fuse holder 50 is in the inserted position, the fuse slots are perpendicular to the bottom 36 and perpendicular to the first 38 and second 40 side walls of the base unit 30. In contrast to the conventional fuse block 2 of FIG. 1, the fuses in the overcurrent protection module 10 according to the present invention are oriented in a plane perpendicular to the plane of the mounting surface. As shown in FIG. 2, the fuses in module 10 are oriented perpendicular to the plane of the DIN rail 20 (defined by the longitudinal 22 and transverse 24 directions), and parallel to the transverse direction 24 of the DIN rail.

Figure 4:
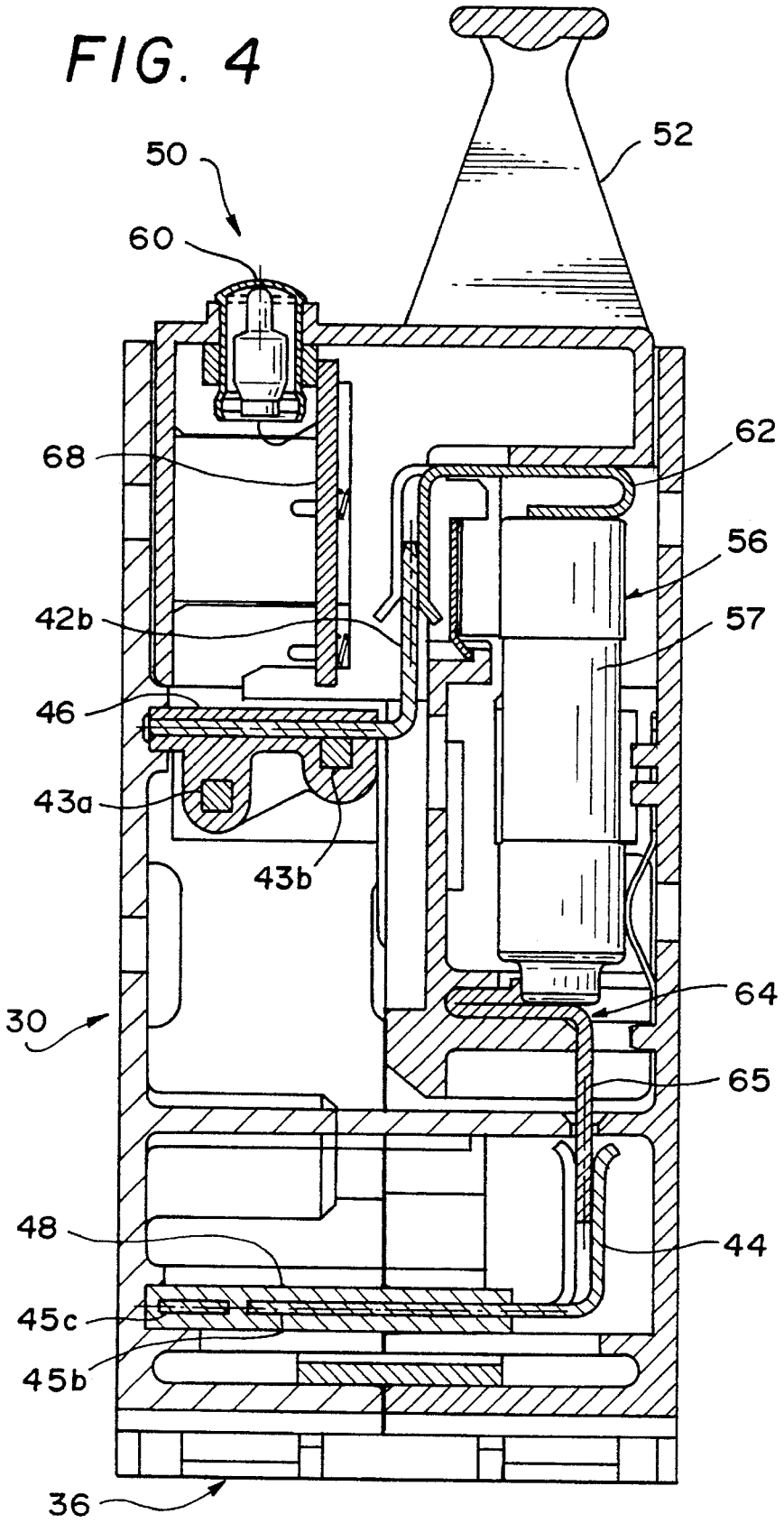
FIG. 4 is a sectional view of the overcurrent protection module with a fuse holder in an inserted position in the base unit.

FIG. 4 is a side sectional view of the overcurrent protection module 10 showing the fuse holder 50 in an inserted position in the base unit 30. The view of FIG. 4 is along a plane through the center fuse holding slot. The indicator lamps 60 include means 68 for lighting the lamp 60 when a fuse has blown to indicate that the fuse must be replaced.

In the inserted position, the fuse holder 50 electrically connects to the base unit 30 to form electrical circuits for each of the fuses in the fuse holder. A single fuse 57 and fuse slot 56 are illustrated in the section shown in FIG. 4, however, it is understood that the fuse holder 50 is formed to hold three or more fuses and the description of the one illustrated fuse slot applies other fuse slots in the fuse holder. A first contact 62 at a first end of the fuse holding slot 56 contacts one end of the fuse 57 and includes a first electrical connector 63 that mates with an electrical connector 42 of the base unit 30. In the embodiment illustrated, the electrical connectors 63, 42 are plug-type connectors that facilitate making a reliable electrical connection when the fuse holder 50 is inserted in the base unit 30. The base unit connector 42 is formed as a blade and the fuse holder connector 63 is formed as a slot to accept the blade. Of course, other suitable connectors may be used. A second contact 64 at the second end of the fuse slot 56 makes contact with the opposite end of the fuse 57 and includes a second electrical connector 65 that mates with an electrical connector 44 of the base unit 30. The electrical connectors 65 and 44 are also plug-type connectors. The fuse holder connector 65 is formed as a blade and the base unit connector 44 is formed as a slot for accepting the blade 65 in the embodiment illustrated.

The electrical connectors 63 at the first end of the fuse slot are arranged in a single first plane adjacent to the first end, as illustrated. The electrical connectors 65 for the second end are arranged in a single second plane that extends from the second end of the fuse slot 56. The first and second planes are parallel to the plane in which the fuse slots 56 are positioned, as may be understood by reference to FIG. 2. The base unit connectors 42, 44 are also positioned in planes to mate with the fuse holder connectors when the fuse holder 50 is inserted into the base unit 30.

Figure 7:
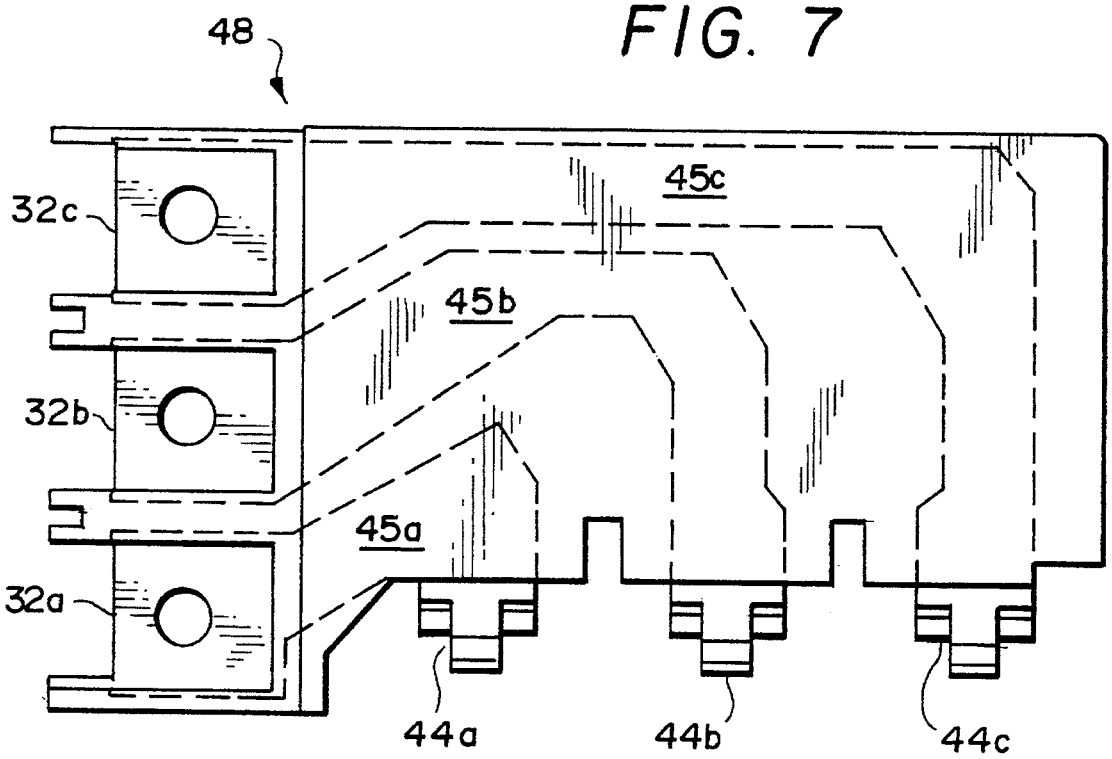
FIG. 7 is a top plan view of a second terminal block removed from the overcurrent protection module to illustrate details; and, FIG. 8 is a side view of the second terminal block of FIG. 7.
Figure 8:
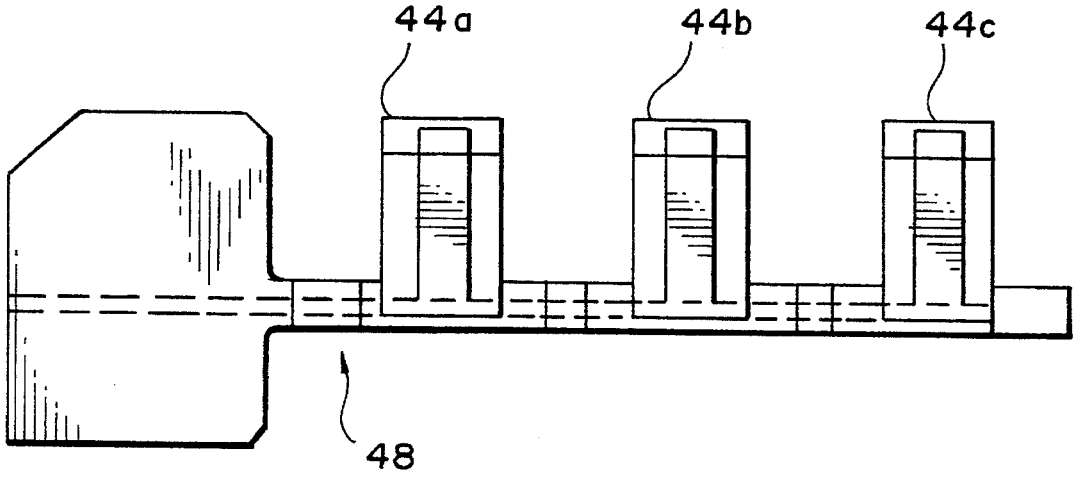

The base unit electrical connectors 42, 44 are respectively supported by a first terminal block 46 and a second terminal block 48 mounted in the base unit. FIGS. 5 and 6 illustrate a first terminal block 46 and FIGS. 7 and 8 illustrate a second terminal block 48. The terminal blocks 46, 48 are substantially planar supporting elements and include the electrical connectors for connecting the base unit 30 to the fuse holder 50. According to a preferred embodiment, the terminals 32, 34 are supported on a portion of the terminal blocks 46, 48 that extends through openings in the first and second walls 38, 40 of the base unit 30 for access from externally of the base unit. The terminal blocks 46, 48 also include electrical conductors leading from and connecting the connectors 42, 44 to the terminals 32, 34, respectively.

As shown in FIGS. 5 and 6, which is a top view of the first terminal block 46, three connectors 42*a*, 42*b* and 42*c* are supported by the terminal block 46 and extend upward (relative to the view of FIG. 6) from the terminal block in a single plane. The load terminals 34 consist of three individual terminal pads 34*a*, 34*b* and 34*c* which are supported by the terminal block 46, and are arranged along a line perpendicular to the line of the connectors 42*a*, 42*b*, 42*c*. Each of the connectors 42*a*, 42*b*, 42*c* is connected to one of the load terminal pads 34*a*, 34*b* and 34*c* by a conductor 43*a*, 43*b*, 43*c*. The conductors 43*a*, 43*b*, 43*c* are supported in the terminal block 46 and are electrically isolated from each other. The routing of the conductors 43*a*, 43*b*, 43*c* permits the relative orientation of the terminals 34 and the connectors 42. As may be seen in FIG. 4, the first terminal block 46 is positioned in an upper portion of the base unit so that the connectors 42 mate with the first fuse holder connectors 63. The first terminal block 46 is shaped to allow space in the base unit 30 for the fuse holder 50 in the inserted position.

FIGS. 7 and 8 illustrate, respectively, a top view and the side view of a second terminal block 48. The three connectors 44*a*, 44*b* and 44*c* are supported by the terminal block 48 in a single plane. The line terminals 32 include three individual terminal pads 32*a*, 32*b*, 32*c* supported by the terminal block 48 in a line perpendicular to the line in which the connectors 44*a*, 44*b*, 44*c* are positioned. Each of the connectors 44*a*, 44*b*, 44*c* is connected by a conductor 45*a*, 45*b*, 45*c* to one of the terminal pads 32*a*, 32*b*, 32*c*. The conductors 45*a*, 45*b*, 45*c* comprise flat electrically conductive material supported in the terminal block 48 and electrically isolated from one another.

The foregoing has described the preferred principles, embodiments and modes of operation of the present invention; however, the invention should not be construed as limited to the particular embodiments discussed. Instead, the above-described embodiments should be regarded as illustrative rather than restrictive, and it should be appreciated that variations, changes and equivalents may be made by others without departing from the scope of the present invention as defined by the following claims.

What is claimed is:

1. An overcurrent protection module comprising:

a removable fuse module containing three fuse holding slots, each fuse holding slot having a longitudinal axis and being positioned in the fuse module so that the fuse holding slots are arranged with longitudinal axes in parallel on a single plane;

a base unit to contain the removable fuse module, the base unit having line terminals and load terminals, all of the line terminals being positioned on a first side wall and all of the load terminals being positioned on an oppositely located second side wall; and a DIN rail adapter attached to the base unit for mounting on a DIN rail having a widthwise and a lengthwise direction, wherein the longitudinal axes of the fuses are oriented perpendicular to both the widthwise and the lengthwise directions of the DIN rail adapter with the plane of the longitudinal axes being parallel to the widthwise direction, and wherein the first and second side walls are oriented parallel to the lengthwise direction when the removable fuse module is inserted into the base unit.

2. An overcurrent protection module as in claim 1 wherein the base module fully encloses a set of fuse clips attached to the fuse holding slots in the removable fuse module.

3. An overcurrent protection module as in claim 1 wherein the removable fuse module, when removed from the base unit, is disconnected from an electrical circuit in the base unit, wherein the fuse holding slots are exposed so that at least one fuse can be replaced.

4. An overcurrent protection module comprising:

a fuse holder having a handle attached to a main body portion;

the main body portion having a flat top surface with at least one fuse indicator lamp disposed thereon;

three fuse holding slots formed integrally with and extending coplanar and vertically downward from the flat top surface of the fuse holder;

a base unit including a generally rectangular body portion having four side walls, top opening, and a bottom, the bottom being connectable to a DIN rail so that the four side walls are perpendicular to both a longitudinal and transverse direction of the DIN rail;

the base unit having line terminals singularly disposed on a first side wall and load terminals singularly disposed on an oppositely located second side wall; and wherein the fuse holder has both an inserted and a removed position, when in the inserted position the flat top surface of the fuse holder closes the top opening of the base unit and the fuse holding slots are disposed parallel to the four side walls of the base unit and the first and second walls are disposed parallel to the longitudinal direction of the DIN rail.

5. The overcurrent protection module of claim 4, wherein the line side terminals are disposed proximate a lower end of the first wall, and the load side terminals are disposed proximate an upper end of the second side wall.

6. The overcurrent protection module of claim 4 further comprising:

a plurality of slotted openings formed in both a third and a fourth of the side walls.

7. An overcurrent protection module comprising:

a fuse holder having a main body portion;

three fuse holding slots formed integrally in the body portion, the three fuse holding slots being coplanar and longitudinally parallel, each fuse holding slot having individual electrical connection means at opposite longitudinal end portions;

a base unit including a generally rectangular body portion having four side walls, a top opening, and a flat bottom connectable to a support so that the four side walls are perpendicular to both a longitudinal and transverse direction of the support;

the base unit having electrical connection means to mate with the electrical connection means of the fuse holder; and the base unit having line terminals singularly disposed on a first side wall and load terminals singularly disposed on an oppositely located second side wall, the electrical connection means connecting to one of the line and load terminals;

wherein the fuse holder has both an inserted and a removed position, and when in the inserted position the fuse holding slots are disposed parallel to the four side walls of the base unit and the fuse holder electrical connection means are mated to the base unit electrical connection means to form three paths from the line to the load terminals.

8. The overcurrent protection module as claimed in claim 7, wherein the load and line terminals are positioned in mutually parallel planar relationship parallel with the bottom of the base unit.

9. The overcurrent protection module as claimed in claim 7, wherein the line terminals are positioned at a lower end portion of the first side wall and the load terminals are positioned at an upper end portion of the second side wall.

10. The overcurrent protection module as claimed in claim 9, wherein the base unit electrical connection means comprises:

a first terminal block mounted in the base unit adjacent to the load terminals and parallel to the bottom, three individual connectors supported by the terminal block and positioned in a plane extending upwardly from the terminal block and perpendicular to the second side wall of the base unit, and three electrical conductors supported by the first terminal block, each conductor connected to one of the connectors and one of the load terminals; and a second terminal block mounted in the base unit adjacent to the line terminals and parallel to the bottom, three individual connectors supported by the second terminal block and positioned in a row perpendicular to the first wall, and three electrical conductors disposed in the second terminal block, each conductor connected to one of the connectors and one of the line terminals.

11. The overcurrent protection module as claimed in claim 10, wherein a portion of the second terminal block extends through the first side wall and supports the line terminals and a portion of the first terminal block extends through the second side wall and supports the load terminals.

12. The overcurrent protection module as claimed in claim 11, wherein the base unit electrical connectors comprise plug-type connectors.

13. The overcurrent protection module as claimed in claim 11, wherein the first electrical connection means at a first end portion of the fuse holder are positioned in a first plane and the second electrical connection means at an opposite second end portion of the fuse holder are positioned in a second plane, both planes being parallel to the plane of the fuse holding slots.

14. The overcurrent protection module as claimed in claim 13, wherein the electrical connection means of the fuse holder comprise plug-type connectors.

* * * * *